US006112369A

United States Patent [19]

Lindsey et al.

[11] Patent Number: 6,112,369

[45] Date of Patent: Sep. 5, 2000

[54] FIGURE EIGHT HINGE

[75] Inventors: Michael Lindsey, Ontario, Calif.; Bob Ingram, Olney, Ill.; Charlie Larsen, Huntington Beach; Gene S. Van Houten, Jr., Woodcrest, both of Calif.

[73] Assignee: Master-Halco, Inc., La Habra, Calif.

[21] Appl. No.: 09/113,004

[22] Filed: Jul. 9, 1998

Related U.S. Application Data

[60] Provisional application No. 60/052,069, Jul. 9, 1997.

[51] Int. Cl.[7] ..... E05D 1/06

[52] U.S. Cl. ..... 16/252; 16/86.1; 16/227; 16/230; 256/1; 256/73; 24/335; 24/284

[58] Field of Search ..... 256/1, 24, 25, 256/26, 73, 21, 22, 65, 59, 68, 69, 60, 19; 403/119, 65, 391, 385, 389, 396, 399, 398; 16/230, 231, 86.1, 252, 253, 392; 49/381, 398

[56] References Cited

U.S. PATENT DOCUMENTS

| | | | |
|---|---|---|---|
| 373,729 | 11/1887 | Eske | 256/21 X |
| 904,791 | 11/1908 | Manlove | 16/253 |
| 1,180,069 | 4/1916 | Osgood | 16/253 |
| 1,232,048 | 7/1917 | Kolkmeier | 16/253 |
| 1,261,678 | 4/1918 | Barnes et al. | 16/253 |
| 2,835,223 | 5/1958 | Erickson | 256/26 X |
| 5,167,049 | 12/1992 | Gibbs | 16/253 |

*Primary Examiner*—Harry C. Kim
*Attorney, Agent, or Firm*—Knobbe, Martens, Olson & Bear, LLP

[57] ABSTRACT

The figure eight hinge of the present invention allows a gate to be quickly and safely attached to a support structure. The hinge includes two legs having two different radii of curvature. The legs also include a slot which allows the hinge to have the desired figure eight configuration. The present invention advantageously eliminates pinch points and minimizes the distance between the gate and the support structure. In particular, the hinge remains stationary with respect to the support structure while allowing the gate to rotate within one end of the hinge. The figure eight hinge is preferably used with animal enclosures such as kennels or pens because it reduces the risk that an animal will catching its feet or other body parts between the gate and the support structure.

16 Claims, 5 Drawing Sheets

FIGURE EIGHT HINGE

CROSS-REFERENCE TO RELATED APPLICATIONS

The present application claims the benefit of provisional application Ser. No. 60/052,069 which was filed on Jul. 9, 1997.

BACKGROUND OF THE INVENTION

1. Field of the Invention

The present invention relates in general to a hinge and, in particular, to a hinge for an enclosure. More particularly, the present invention is an improved hinge for an animal enclosure such as a kennel.

2. Description of Related Art

Fences are conventionally used for a wide variety of applications, including enclosing or boarding fields or yards. Fences commonly include one or more openings which allow objects to traverse the fence. These openings typically include a door or gate to control the movement of objects from one side of the fence to the other. The gate is frequently connected to the fence by one or more hinges.

Conventional gate hinges are composed of two braces, each with an outwardly extending flange, and a hinge pin. One brace is connected to the fence post or support structure and the other brace is connected to the gate. The outwardly extending flanges are connected to one another by the hinge pin. The gate pivots around the hinge pin so that the entrance to the enclosure can be opened or closed. Disadvantageously, there is often a large gap or space between the gate and the fence post because the flanges and hinge pin are generally located between the gate and the fence post. The flange and hinge pin are often located in this position to allow the gate to pivot both forwardly and backwardly, and so that these elements do not protrude inwardly or outwardly from the fence.

The gap between the gate and the fence post allows items to be caught in the opening. For example, if conventional hinges are used on an animal enclosure, such as a kennel, an animal can get its nose, leg, paw or other body part wedged into the opening and this is often very painful and it can seriously injure the animal. Further, conventional hinges often cause the edge or frame of the gate to move towards the fence post while the gate is being opened or closed. This allows animals or other objects to be pinched between the gate and the fence post, which is also very painful and may seriously injury to the animal.

There are also other disadvantages associated with traditional hinges used to attach a gate to a fence. First, conventional hinges are difficult to assemble because they require the installer to use several steps to secure the braces to the fence post and the gate. For example, the installer must fasten one brace to the support structure and the other brace to the gate. Then the installer must align the outwardly extending flange of the two braces so that the two flanges can be connected by the hinge pin. These steps are time consuming and require significant effort by the installer.

Second, traditional hinges create pinch points which may cause painful injuries. For example, if a person or animal touches or leans against the hinge while the gate is in motion, the person or animal can catch its flesh or hair in the openings to the flanges or about the hinge pin. This can be very painful and cause serious injury.

As shown in FIGS. 1 and 2, a conventional gate hinge 10 includes a gate frame hinge 12 with a first leg 14 and a second leg 16 which extend generally parallel to a longitudinal axis 18 that extends through the center of the hinge. The first leg 14 and second leg 16 are joined by a curved section 20 which extends almost 360°. The curved section 20 has a generally circular opening 22 that receives the hinge pin. The opening 22 typically has an inside diameter of about 0.55 inches (1.4 cm).

As seen in FIG. 1, the first leg 14 and second leg 16 of the gate frame hinge 12 are generally mirror images that are located on opposing sides of the longitudinal axis 18. The first leg 14 and second leg 16 include connecting portions 24 and 26 with a length of about 0.7 inches (1.8 cm) and rounded portions 28 and 30 which form an opening 32. The opening 32 has an inside diameter of about 1.3 inches (3.3 cm) and it is attached to the frame of the gate. The legs 14 and 16 also include outwardly extending projections 34 and 36 which have a length of about 1 inch (2.5 cm). As best seen in FIG. 2, the conventional gate frame hinge 12 includes a square opening 38 extending through the projection 34 and a square opening 39 extending through the projection 36.

The conventional gate hinge 10 also includes a post hinge 40, as shown in FIGS. 3 and 4. The post hinge 40 has a first leg 42 and a second leg 44 which have the same general shape and configuration as the legs 14 and 16 of the gate frame hinge 12. In particular, the post hinge 40 includes curved section 45 surrounding the hinge pin 46. The post hinge 40 also includes connecting portions 47 and 48; rounded portions 49 and 50; projections 51 and 52; and an opening 53 to receive the post. As best seen in FIG. 4, the projection 51 includes a square opening 53 and the projection 52 includes a square opening 54. Additionally, the post hinge 40 includes a tack weld 55 and an indentation 56. The tack weld 55 attaches the legs 42 and 44 proximate the curved section 45 and the tack weld may be used to secure the hinge pin 46 in the desired position. Additionally, the indentation 56 may be used to secure the hinge pin 46 in the desired location. A carriage bolt 57 as shown in FIGS. 5 and 6 is used to connect the projections 34 and 36 of the first leg 14 and second leg 16, respectively, of the gate frame hinge 12. The bolt 57 has a threaded portion 58 and a head 59. A carriage bolt is also be used to connect the projections 51 and 52 of the post hinge 40.

The attachment of the gate frame hinge 12 to the gate and the post hinge 40 to the post is often difficult and time consuming. Further, for those who are not skilled in using conventional gate hinges, it is awkward and troublesome to correctly align and attach the gate frame hinge 12 to the post hinge 40. Further, the conventional gate hinge 10 allows people working with the gates, or animals enclosed by them to get pinched by the hinge, and the significant gap between the gate and the fence post allows persons or animals to catch their body parts within the opening.

SUMMARY OF THE INVENTION

A need therefore exists for an apparatus and method that allows a gate to be quickly and safely attached to a support structure, without the above-described disadvantages.

One aspect of the invention is a hinge for attaching a gate to a support structure. The hinge includes first and second legs, each having a first end, a second end, a first radius of curvature, and a second radius of curvature. The first radius of curvature of the first leg and the first radius of curvature of the second leg are adapted to receive a portion of the support structure, and the second radius of curvature of the first leg and the second radius of curvature of the second leg are adapted to receive a portion of the gate. Preferably, the hinge includes a slot in the first leg between the first radius of curvature and the second radius of curvature, and a slot in the second leg between the first radius of curvature and the second radius of curvature. These slots allow the first leg and the second leg to be arranged generally in a figure eight design.

The present invention is a gate hinge that is easy to install, eliminates pinch points and minimizes the distance between the gate and the support structure. In particular, the hinge remains stationary with respect to the support structure while allowing the gate to rotate within one end of the hinge. This allows the distance between the support structure and the gate to be minimized. Thus, the risk of injury to an animal as the result of catching its feet or other body parts between the gate and the support structure is greatly reduced. Additionally, the risk that an object will be caught between the gate and the support structure is further reduced because the edge of the gate adjacent to the support structure does not move closer to the support structure while the gate is being opened or closed.

Another aspect of the invention is a hinge assembly for attaching a gate to a support structure. The hinge assembly includes a hinge with a first leg and a second leg. The legs include an aperture and a slot, and a fastener is configured to be inserted through the apertures. Tightening the fastener causes the hinge to be clamped to the support structure.

Yet another aspect of the invention is a hinge for attaching a gate to a support structure. The hinge includes first and second members having a generally S-shaped configuration and a slot which allows the first member and the second member to be generally arranged in a figure eight configuration. Preferably, the slots are generally positioned between a first radius of curvature and a second radius of curvature of each of the members. Additionally, the members preferably include a flange which has an opening configured to receive a fastener which is used to tighten the hinge about the support surface.

The present invention has a unique figure-eight design that allows the installer to clamp one side of the hinge securely to the support structure while the gate is pivotally attached to the other side of the hinge. Significantly, the hinge of the present invention can be quickly attached to both the gate and the support structure by a single bolt. The hinge also uses a single bolt to attach the hinge to the support structure. The hinge is desirably configured such that tightening of the bolt causes one side of the hinge to securely clamp about the support structure while allowing the gate to be rotatably connected to the other side of the hinge.

Additionally, in a the preferred embodiment of the present invention, the hinge increases security by making it difficult, if not impossible, for the gate to be removed without the use of tools. In particular, the bolt that secures the hinge to the support structure can be tightened to such a degree that removing it without the use of a tool is virtually impossible. Thus, the hinge of the present invention increases safety.

Further, the present invention is easy to install. Thus, consumers and purchasers can quickly and easily attach the hinge to the support structure and to the gate. In contrast, conventional gate hinges are more difficult and time consuming to install.

Other aspects, features and advantages of the present invention will become apparent from the following detailed description of the preferred embodiment.

BRIEF DESCRIPTION OF THE DRAWINGS

The appended drawings contain figures of conventional gate hinges, which were discussed above, and figures of the preferred embodiment of the present invention. The above-mentioned features of the present invention, as well as other features, will be described in connection with the preferred embodiment; however, the illustrate embodiment is intended to illustrate and not limit the invention. The drawings contain the following figures.

DETAILED DESCRIPTION OF THE PREFERRED EMBODIMENTS

The present invention involves a hinge which is used to attach a gate to a support structure. The support structure, for example, but without limitation, can be a fence post, fence frame, wall, support, or any other desired structure or object that allows a gate to be pivotally attached. More preferably, the support structure is a portion of an animal enclosure, such as a pen or kennel, that allows the gate to be pivotally attached. The term gate is used broadly to include, for example, but without limitation, a door, portal, inclosure, and the like.

The principles of the present invention, however, are not limited to animal enclosures and it will be understood that, in light of the present disclosure, the hinge disclosed herein can be successfully used in connection with other types of gates and fence systems.

Additionally, to assist in the description of the components of the present invention, words such as upward and downward are used to describe the accompanying figures. It will be appreciated, however, that the present invention can be located in a variety of desired positions—including various angles, sideways and even upside down. A detailed description of the hinge follows.

Figure 7:
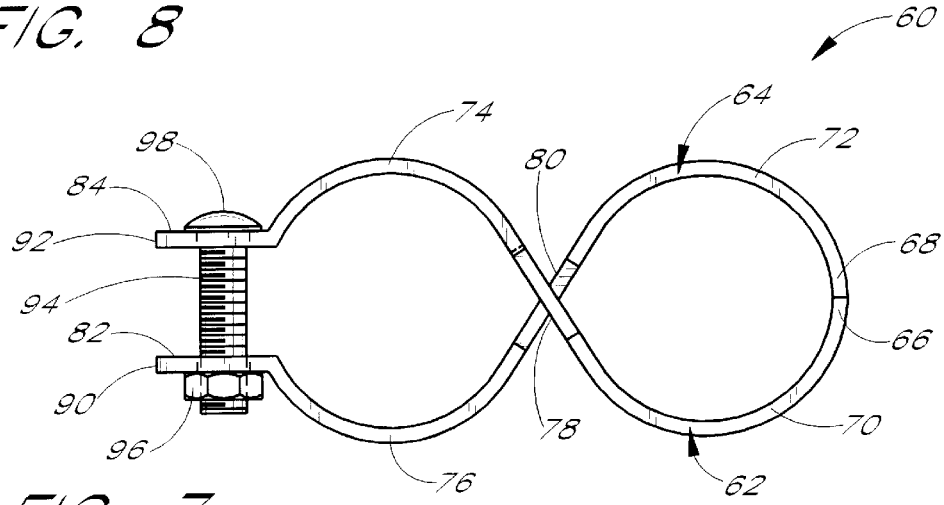
FIG. 7 is a top view of a hinge in accordance with the preferred embodiment of the present invention.

FIGS. 7–10 illustrate the preferred embodiment of the hinge 60. As best seen in FIG. 7, the hinge 60 includes a first leg 62 and a second leg 64 which are configured to form generally a figure eight design. The legs 62 and 64 preferably have the same general shape, and the legs have first ends 66 and 68, respectively, which are configured to touch or engage during use. The legs 62 and 64 also include first curved sections 70 and 72, respectively, and second curved sections 74 and 76, respectively, to form generally "S"-shaped legs. Located between the first and second curved sections are generally "U"-shaped slots 78 and 80, respectively, which have an opening of about 0.5 inches (1.3 cm) and a depth of about 0.75 inches (1.9 cm), but the opening and depth of the slots can be larger or smaller.

Figure 2:
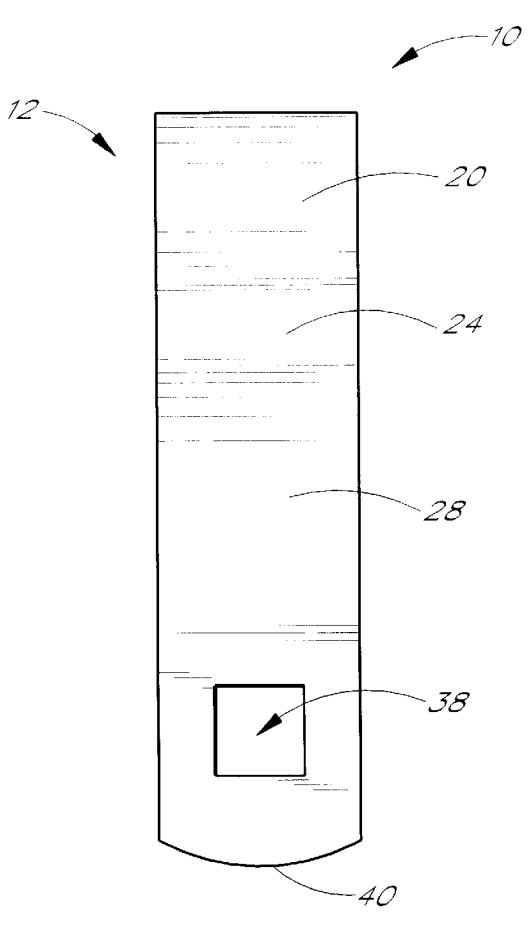
FIG. 2 (PRIOR ART)
FIG. 2 is a side view of the portion of the gate hinge shown in FIG. 1.
Figure 1:
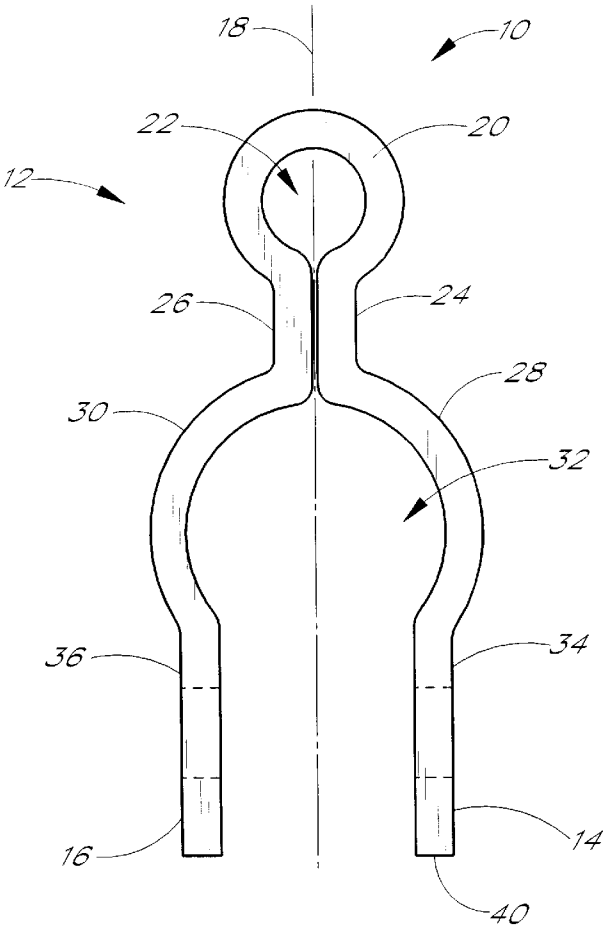
FIG. 1 (PRIOR ART)
FIG. 1 is a top view of a portion of a conventional gate hinge, illustrating the gate frame hinge.
Figure 4:
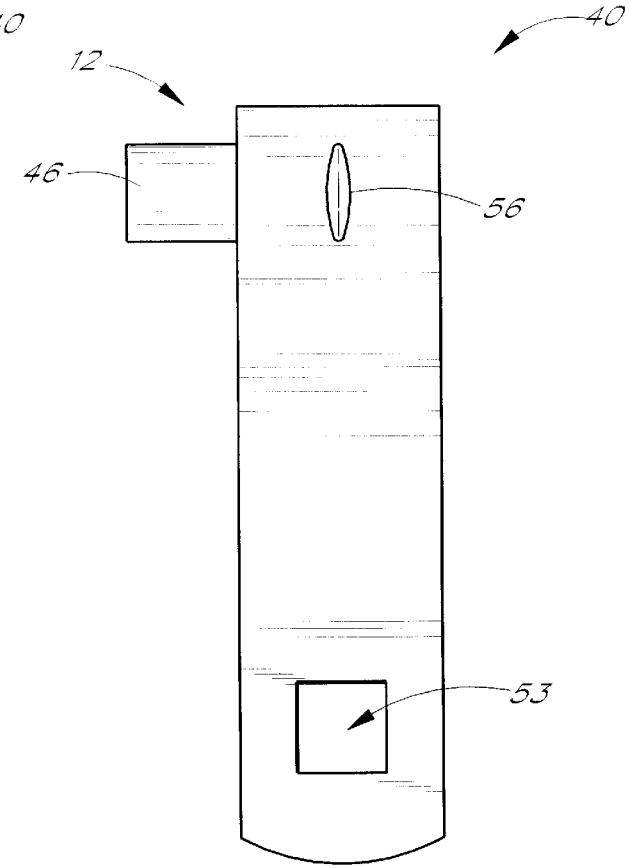
FIG. 4 (PRIOR ART)
FIG. 4 is a side view of the portion of the gate hinge shown in FIG. 3.
Figure 3:
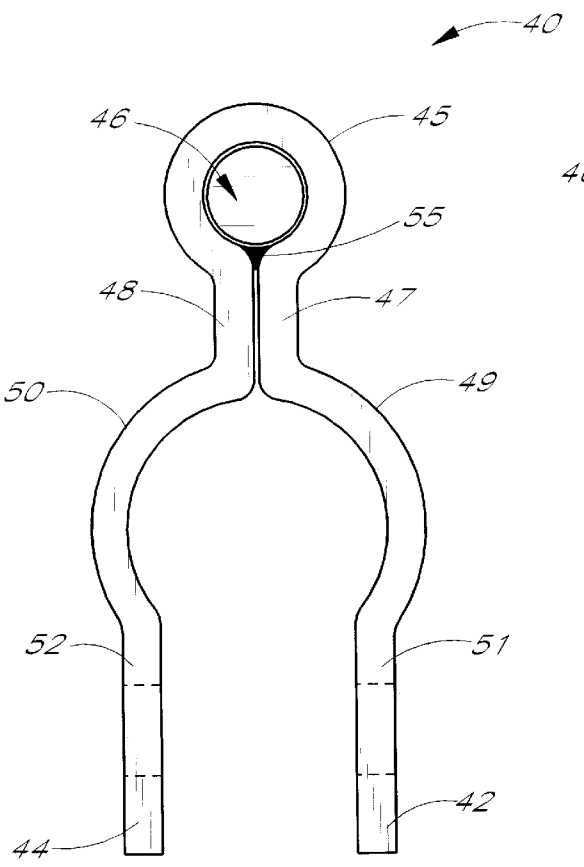
FIG. 3 (PRIOR ART)
FIG. 3 is a top view of another portion of the gate hinge shown in FIG. 1, illustrating the post hinge.
Figure 5:
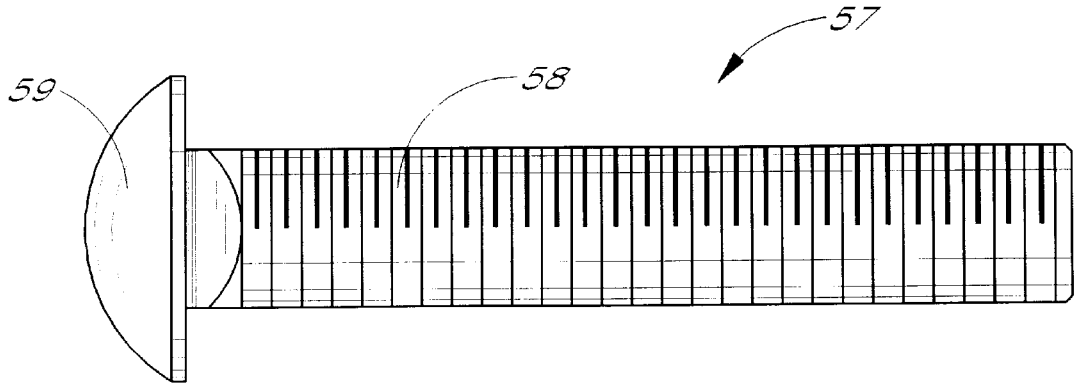
FIG. 5 (PRIOR ART)
FIG. 5 is a side view of a fastener used in connection with the conventional gate hinge.
Figure 6:
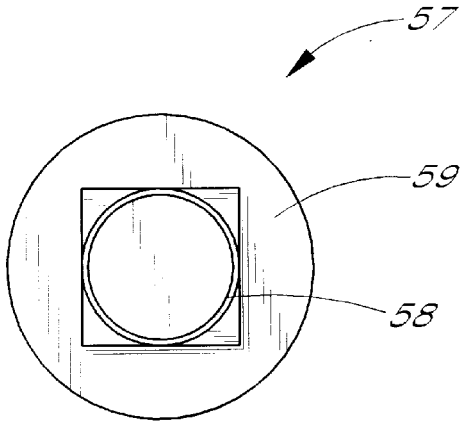
FIG. 6 (PRIOR ART)
FIG. 6 is an end view of the fastener shown in FIG. 5.
Figure 9:
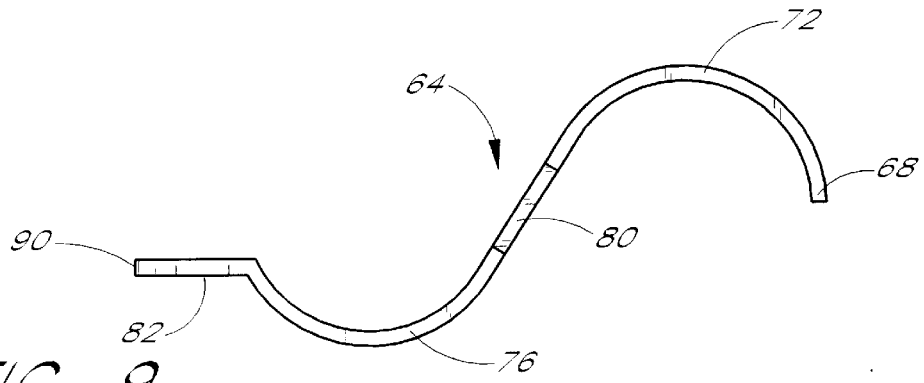
FIG. 9 is a top view of the portion of the hinge shown in FIG. 8.
Figure 8:
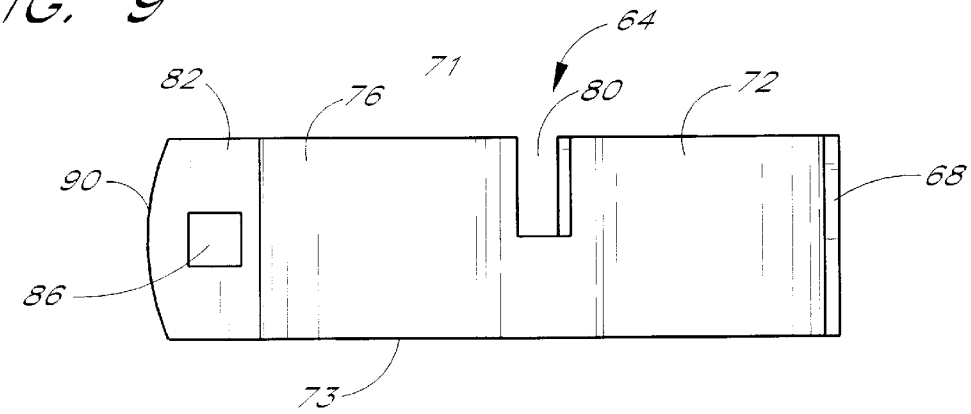
FIG. 8 is a side view of a portion of the hinge shown in FIG. 7, illustrating a leg of the hinge.
Figure 10:
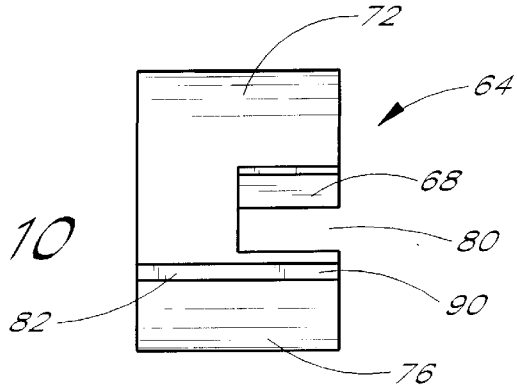
FIG. 10 is a front view of the portion of the hinge shown in FIG. 8.

As best seen from FIGS. 8 and 10, the leg 64 has a pair of side edges 71 and 73, and the open end of the slot 80 opens to the side edge 71. Further, the closed end of the slot is about half way between the edges 71 and 73. As indicated above, the legs 62 and 64 preferably have the same general shape, and hence the slot 78 for the leg 62 is substantially the same as the slot 80.

Extending from the ends of the second curved sections 74 and 76 are flanges 82 and 84 which are about 0.625 inches (1.6 cm) in length, but the flanges may have any desired length. As best seen in FIG. 8, the flange 82 include a square opening 86 with sides that are about 0.4 inches (1 cm) in length and the opening is preferably spaced about 0.4 inches (1 cm) from the second end 90 of the first leg 62. The second leg 64 includes an opening 88 in the flange 84 which is also positioned about 0.4 inches (1 cm) from the second end 92 of the leg. It will be appreciated that the flanges 82 and 84 and openings 86 and 88 may have any desired size and configuration.

Figure 11:
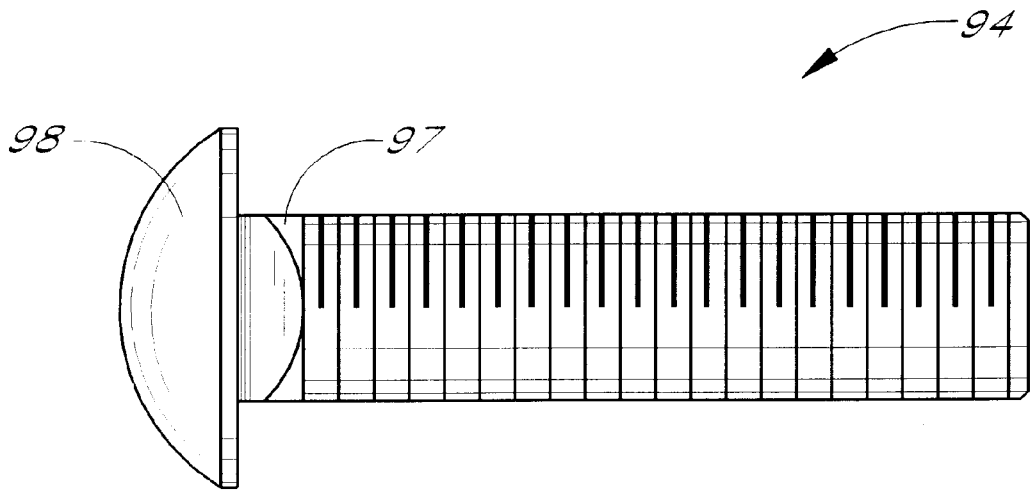
FIG. 11 is a side view of a fastener used in connection with the hinge shown in FIG. 7.
Figure 12:
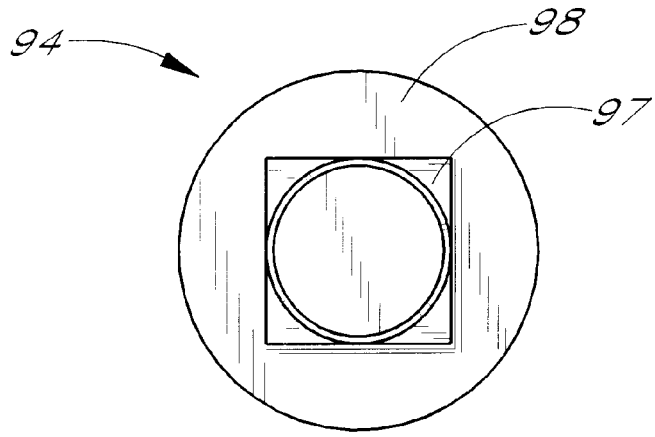
FIG. 12 is an end view of the fastener shown in FIG. 11.

A fastener such as a carriage bolt 94 is configured to fit through the openings 86 and 88 of the flanges 82 and 84. The fastener 94, as shown in FIGS. 11 and 12, is preferably about 1.5 inches (3.8 cm) in length and has a diameter of about 0.37 inches (0.9 cm), but the fastener may have any desired length and thickness. Additionally, a nut 96 may be secured to the end of the fastener. Desirably, the fastener 90 includes a square section 97 located near the head 98 which is configured to fit through and engage one of the square opening 86 or 88 in the flanges 82 and 84, respectively. Advantageously, when the square section 97 contacts or engages the square openings 86 or 88, the fastener 94 does not freely rotate and this assists in tightening the nut 96 to the fastener. It will be understood that any desired type of fastener may be used, for example, but without limitation, screws, locks, latches, chains, magnets, etc.

In the preferred embodiment of the invention, the first curved sections 70 and 72 have a radius of curvature of about 0.7 inches (1.8 cm) and the center of the curved section is about 0.975 inches (2.5 cm) from the first ends 66 and 68 of the hinge. The slots 78 and 80 are located in generally planar sections of the legs 62 and 64 that are about 0.5 inches (1.3 cm) in length. The second curved sections 74 and 76 preferably have a radius of curvature of about 0.68 inches (1.7 cm) and the distance from the center of the first curved sections 70 and 72 to the center of the second curved sections is about 2.25 inches (5.7 cm). Additionally, the distance from the center of the first curved sections 70 and 72 to the center of the openings 86 and 88 is about 3.4 inches (8.6 cm). Further, the distance between the flanges 82 and 84 is preferably about 0.75 inches (1.9 cm). One skilled in the art will understand the hinge 60 can also have larger or smaller dimensions.

The hinge 60 preferably has an overall length of about 4.5 inches (11.4 cm) and a height of about 1.5 inches (3.8 cm). The hinge 60 is preferably constructed from 8 gauge steel which has a thickness of about 0.086 inches (0.2 cm), but the hinge can be thicker or thinner depending upon, for example, the type of material used to construct the hinge and/or the desired strength of the hinge. It will be appreciated that the hinge 60 may have various lengths, widths, radii of curvatures, etc., depending upon the desired use of the hinge. For example, the radii of curvatures for the first and second curved sections 70, 72, 74 and 76 may be larger or smaller to accommodate gate frames and support structures of various sizes.

In use, the first leg 62 of the hinge 60 is positioned with a portion of the gate frame adjacent or abutting the inner curved surface of the first section 70 and a portion of the support structure is positioned adjacent or abutting the inner curved surface of the second section 74 of the first leg. The slot 78 in the first leg 62 is positioned in a downward facing direction. The second leg 64 is then positioned with a portion of the gate frame adjacent or abutting the inner curved surface of the first section 72 and a portion of the support structure is positioned adjacent or abutting the inner curved surface of the second section 76 of the second leg. The slot 80 in the second leg extends in an upward direction, and the first leg 62 and second leg 64 are then positioned adjacent to each other with the openings 86 and 88 in the flanges 82 and 84, respectively, generally aligned. The fastener 94 is then inserted through openings 86 and 88 and the nut 96 is attached to the end of the fastener. It will be understood that the hinge 60 may also be used in a variety of different ways. For example, the second leg 64 may be positioned adjacent to the gate and support structure before the first leg 62, or the first curved sections 72 and 74 may be attached to the support structure and the second curved sections 74 and 76 may be attached to the gate.

When the fastener 94 is then tightened, this draws the flanges 82 and 84 and curved sections 74 and 76 closer together, and the curved sections clamp about the support post. The fastener 94 is preferably tightened so that the hinge 60 is tightly fastened to the support post and the hinge does not rotate or move with respect to the support post. The first and second curved sections 70 and 72 of the hinge 60, however, do not clamp around the gate frame so tightly that the gate frame cannot rotate within this portion of the hinge. In contrast, the first curved sections 70 and 72 of the hinge 60 are positioned to create a friction or interference fit with the gate frame. This allows the gate frame to rotate or turn within this portion of the hinge. Thus, when sufficient force is applied to the gate to overcome the friction or interference fit, the gate can be rotated into an opened or closed position.

The hinge 60 of the present invention allows the support post and gate frame to be positioned or spaced very closely to each other. Advantageously, this assists in preventing items such as an animal's leg or paw from being pinched. Additionally, the support post and gate frame remain separated by a generally constant distance, which also helps prevent items from being caught or pinched.

The hinge 60 is preferably manufactured by casting or forming steel into the desired shape and configuration. It will be appreciated that the hinge could also be stamped, cut or formed from a material such as steel or aluminum. Alternatively, the hinge could be constructed from other materials such as plastics or composites.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A hinge for attaching a gate to a support structure, the hinge comprising:

a first leg having a first end, a second end, first and second edges extending between said ends, a first curved section, and a second curved section;

a second leg having a first end, a second end, first and second edges extending between said ends, a first curved section, and a second curved section;

a slot in the first leg between the first leg first and second sections, the slot being open on one end to an edge of said first leg, said slot being sized to receive one of the edges of said second leg, so that when said one of said edges of said second leg is within said slot, the first curved section of the first leg and the first curved section of the second leg form a space adapted to receive a portion of the support structure and the second curved section of the first leg and the second curved section of the second leg form a space adapted to receive a portion of the gate.

2. The hinge of claim 1, wherein the first end of the first leg abuts the first end of the second leg.

3. The hinge of claim 1, further comprising a slot in the second leg between the second leg first curved section and the second curved section, said slots being configured so that the legs may be positioned with a portion of each leg between its curved sections within the slot of the other leg and with said first curved sections.

4. The hinge of claim 3, wherein the slots allow the first leg and the second leg to be arranged in generally a figure eight design.

5. The hinge of claim 1, wherein the second end of the first leg includes an outwardly extending flange and the second end of the second leg includes an outwardly extending flange.

6. The hinge of claim 5, further comprising an opening in the flange extending from the first leg and an opening in the flange extending from the second leg, the openings configured to receive a fastener.

7. The hinge of claim 5, further comprising an opening extending through each of said flanges, and a fastener configured to be inserted through said openings, wherein the fastener is configured to tighten the hinge about the support structure.

8. A hinge for attaching a gate to a support structure, the hinge comprising:

a first member having a generally S-shape configuration;

a second member having a generally S-shape configuration;

a slot in the first member open to an edge of the first member;

a slot in the second member open to an edge of the second member;

wherein the slot in the first member and the slot in the second member interengage to allow the first member and second member to be generally arranged in a figure eight configuration.

9. The hinge of claim 8 wherein an end of the first member abuts an end of the second member.

10. The hinge of claim 8 wherein the S-shape configurations each have first and second curved sections and the slot in each member is generally positioned between its curved sections.

11. The hinge of claim 8, wherein the first member includes a flange and the second member includes a flange.

12. The hinge of claim 11, further comprising an opening in the flange of the first member and an opening in the flange of the second member, wherein the openings are generally aligned.

13. The hinge of claim 12, further comprising a fastener configured to be inserted through the opening in the flange of the first member and the opening in the flange of the second member to tighten the hinge about the support surface.

14. A method of making a gate hinge comprising:

providing first and second members, each member having a generally S-shape configuration which creates a pair of curved sections;

providing a slot in said each member with the slot having an open end open to an edge of said each member at a location generally between said curved sections;

providing a flange on one end of said each member with an aperture therein for receiving a fastener;

interengaging the slots of said members so that the members are arranged in substantially a figure eight configuration with the curved sections of the members forming an opening for receiving a portion of a gate and an opening for receiving a portion of a support structure; and positioning said members in the figure eight configuration so that the flanges of the members are aligned to receive a fastener for tightening the members against one of the support structure and the gate.

15. The method of claim 14 including the step of positioning said members so that ends of said members opposite from said flanges engage each other to limit the size of the opening formed by the curved sections adjacent those engaging ends.

16. A gate hinge comprising:

a hinge member having a pair of curved sections joined by a generally straight section, with the member having a pair of spaced S-shaped edges giving the member a generally S-shaped configuration;

a slot formed in said straight section, the slot having an end that opens to one of said edges and a closed end between the edges, the slot having a width greater than a thickness of said edge so that the edge of a similar hinge member will fit into the slot; and a flange on one end of said member with a hole in the flange for receiving a fastener.

* * * * *